US005164702A

United States Patent [19]

Vogt

[11] Patent Number: 5,164,702

[45] Date of Patent: Nov. 17, 1992

[54] TEST APPARATUS AND METHOD FOR SECURITY SYSTEM

[75] Inventor: William R. Vogt, Rockaway, N.J.

[73] Assignee: Baker Industries, Inc., Parsippany, N.J.

[21] Appl. No.: 632,569

[22] Filed: Dec. 24, 1990

[51] Int. Cl.[5] ..... G08B 26/00

[52] U.S. Cl. ..... 340/505; 340/518; 340/541; 340/825.1; 340/825.07

[58] Field of Search ..... 340/505, 514, 518, 520, 340/565, 825.06, 825.07, 825.08, 825.1, 541

[56] References Cited

U.S. PATENT DOCUMENTS 4,342,986 8/1982 Buskirk et al. ..... 340/505
4,470,047 9/1984 Vogt et al. ..... 340/825.36
4,581,604 4/1986 Kimura et al. ..... 340/505

*Primary Examiner*—Edward L. Coles, Sr.
*Assistant Examiner*—Jill Jackson
*Attorney, Agent, or Firm*—James J. Jennings

[57] ABSTRACT

A security system provides for bidirectional communication between a controller and a plurality of addressable transponders. At least one transponder includes a sensor circuit for detecting motion, which motion is indicated by the transponder signalling back to the controller. During a walk test the controller sends a signal back to the transponder, completing the circuit for the visible output indicator so that subsequent motions during the walk test sequence will be immediately displayed at the transponder, without necessitating successive communication through the loop including the controller. In systems where the controller itself reports upwardly in a hierarchy of units, the walk test can confirm operability of the entire system, including other condition-indicating signals.

7 Claims, 4 Drawing Sheets

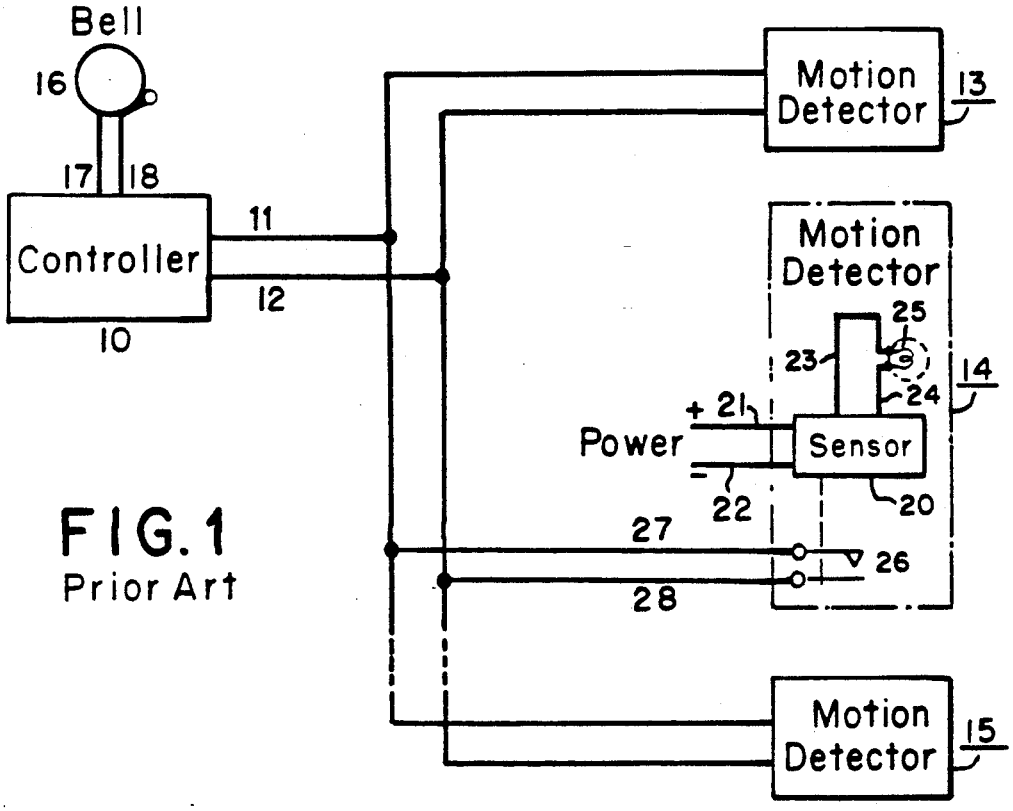
FIG. 1
Prior Art
FIG. 2
Prior Art
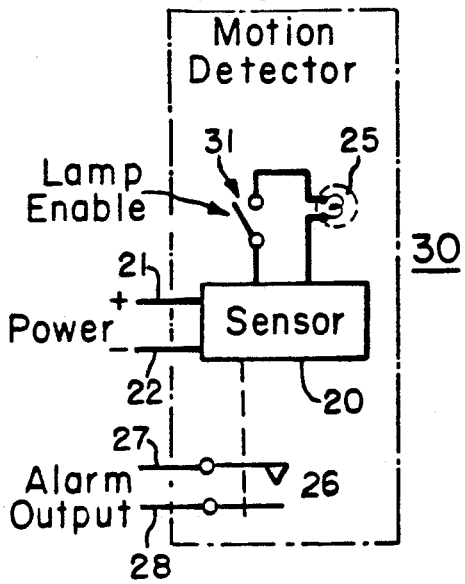
FIG. 3
Prior Art
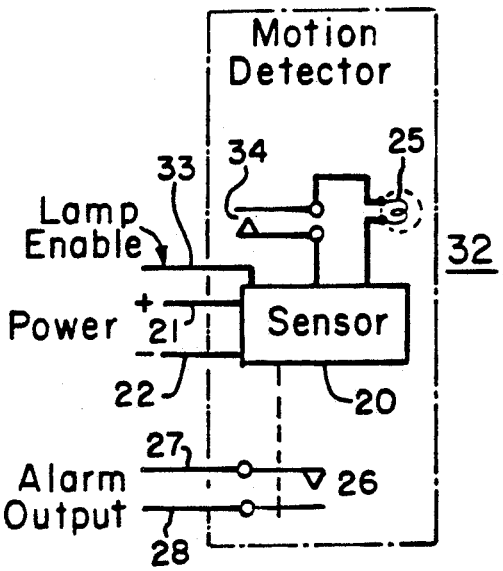

TEST APPARATUS AND METHOD FOR SECURITY SYSTEM

BACKGROUND OF THE INVENTION

Many security systems include various types of sensors and monitors, such as those for detecting intrusion, presence of particles of combustion, motion within a given area, and so forth. The present invention is directed in general to such systems which include motion detectors, and more particularly to a test arrangement and method for insuring the operability of the motion detectors, and the system in which the motion detectors are connected, with a minimum of inconvenience and false alarming.

The type of test for a motion detector is frequently termed a "walk test". The unit generally includes a visible indicator, such as a light-emitting diode (led), or some similar unit which will provide a visible indication when energized. In its simplest arrangement, the one testing the unit merely walks in the protected zone, and visually inspects the state ("off" or "on") of the led to determine whether his movement has been detected. A bell or other audible output unit is generally connected to a controller which receives the alarm-indicating signals from the motion detector, and this bell sounds to confirm to the person doing the walk test that the controller "saw" his movement. If there are a plurality of motion detectors being supervised by a single controller, as is generally the case, the system does not know which motion detector was alarmed. Moreover the continual sounding of the audible output as the one testing goes from detector to detector develops the "cry wolf" syndrome, and generally the attention paid to the audible output diminishes with successive testing. There is also a certain interruption or annoyance caused by the sounding of the bell during the testing.

Of course the particular detector need not send an alarm signal back to the controller, but if there is no response from the system, the portion of the system network between this individual detector and the controller is not tested and confirmed as being in readiness to convey the signal if there were a real alarm.

Another type of walk test for such systems may include a mechanical switch, generally in the base or housing of the motion detector, which can be reached by the person doing the motion test. Very often when the motion detector is above a normal arm's reach, a pole or other extension member must be carried to actuate the switch and enable the led. This is awkward and suffers from the same drawbacks of the switch testing described above, in that the audible confirmation is annoying and diminishes the attention paid to the actual alarm signal. In some variations the switch is made to restore automatically after a predetermined time, to force the led back to the off state.

One attempt to improve upon the walk test arrangement of such motion detector systems includes the provision of a communication circuit coupled with the motion detector sensor, so that this circuit can send a signal back to the controller when the sensor detects motion in the protected zone. The controller recognizes the alarm-indicating signal from the communication circuit, and then sends a signal back to the communication circuit to energize the led or other output. This can be effected through a relay or semiconductor switch in the communication circuit. As soon as the motion ceases in this system, the relay switch is deenergized and the led is no longer illuminated. In this arrangement the next movement adjacent the sensor must again send a signal back to the controller, with a resulting command from the controller to again illuminate the led. This creates a system delay which slows down the effective testing of the motion detector arrangement.

It is therefore a principal consideration of the present invention to provide an improved walk test system for a security arrangement which overcomes the deficiencies of the earlier systems as set out above.

A more particular consideration of the present invention is the provision of such an improved system and testing arrangement in which, after the initial recognition at the controller of an alarm sensed back at the motion detector, the controller sends back a "turn-on" signal to enable the led. Thereafter the led follows the output of the local motion detector and is immediately illuminated when the next motion occurs, thus obviating the system delay encountered in earlier systems.

Another significant consideration of the present invention is the provision of such an improved testing arrangement connected in a hierarchical system, with a first order controller communicating through a second order controller to a plurality of transponders. The walk test can check not only the second order but also the first order controller, and associated components. This system can also examine different conditions, such as appropriate operation of smoke detectors and/or access control sensors, system batteries fully charged, lights off (at preassigned times), heat turned down, and so forth, before allowing the led to be energized to indicate those conditions have been satisfied.

SUMMARY OF THE INVENTION

A security system constructed in accordance with the invention comprises a controller for receiving an alarm signal, and for providing an output control signal when commanded. The system includes an addressable transponder circuit which is capable of communicating with the controller. At least one sensor circuit is coupled to the transponder circuit. The sensor circuit includes indicating means, and also includes a sensor for providing an alarm output signal to the transponder circuit, which in turn communicates the alarm output signal to the controller. Thereafter the controller sends an output control signal to the transponder circuit, which enables the sensor circuit indicating means. This occurs only after the alarm output signal from the sensor is "seen" and recognized back at the controller, which then provides the output control signal which ultimately enables the sensor circuit and energizes the indicating means, such as a lamp indicator.

Considered from another aspect, the invention includes a novel and unobvious method of testing a security system which has a controller communicating bidirectionally with a plurality of addressable transponders, and a sensor circuit and indicating means associated with at least one of the transponders. The testing method comprises the steps of producing an alarm condition at the one transponder and then passing an alarm signal from that transponder back to the controller. The alarm signal is recognized at the controller, which in turn provides an output control signal back to the transponder. This output control signal is used to enable an energizing circuit for an alarm-indicating component, such as a lamp, at the one transponder, but only after (1) the alarm condition has been recognized at the controller, and (2) the controller has provided the output control signal which ultimately energizes the indicating means.

The testing method can also include additional controllers and other components in a hierarchy of components connected, by way of example, through a room, building, complex of two or more buildings, and through a geographical region to a central controller. The system can indicate not only effective operation of all the layers of control, but also that certain conditions, such as appropriate sensitivity of smoke detectors, proper condition of access control units, full battery charge, light and heat at appropriate levels, and so forth, have been satisfied. In other words, if the led is turned on, it signifies "all systems are go."

THE DRAWINGS

In the several figures of the drawings, like reference numerals identify like components, and in those drawings:

FIG. 1 is a block diagram, partly in schematic form, of a prior art security system using motion detectors;

FIGS. 2 and 3 are simplified showings of other prior art motion detector units;

PRIOR ART ARRANGEMENTS

Figure 4:
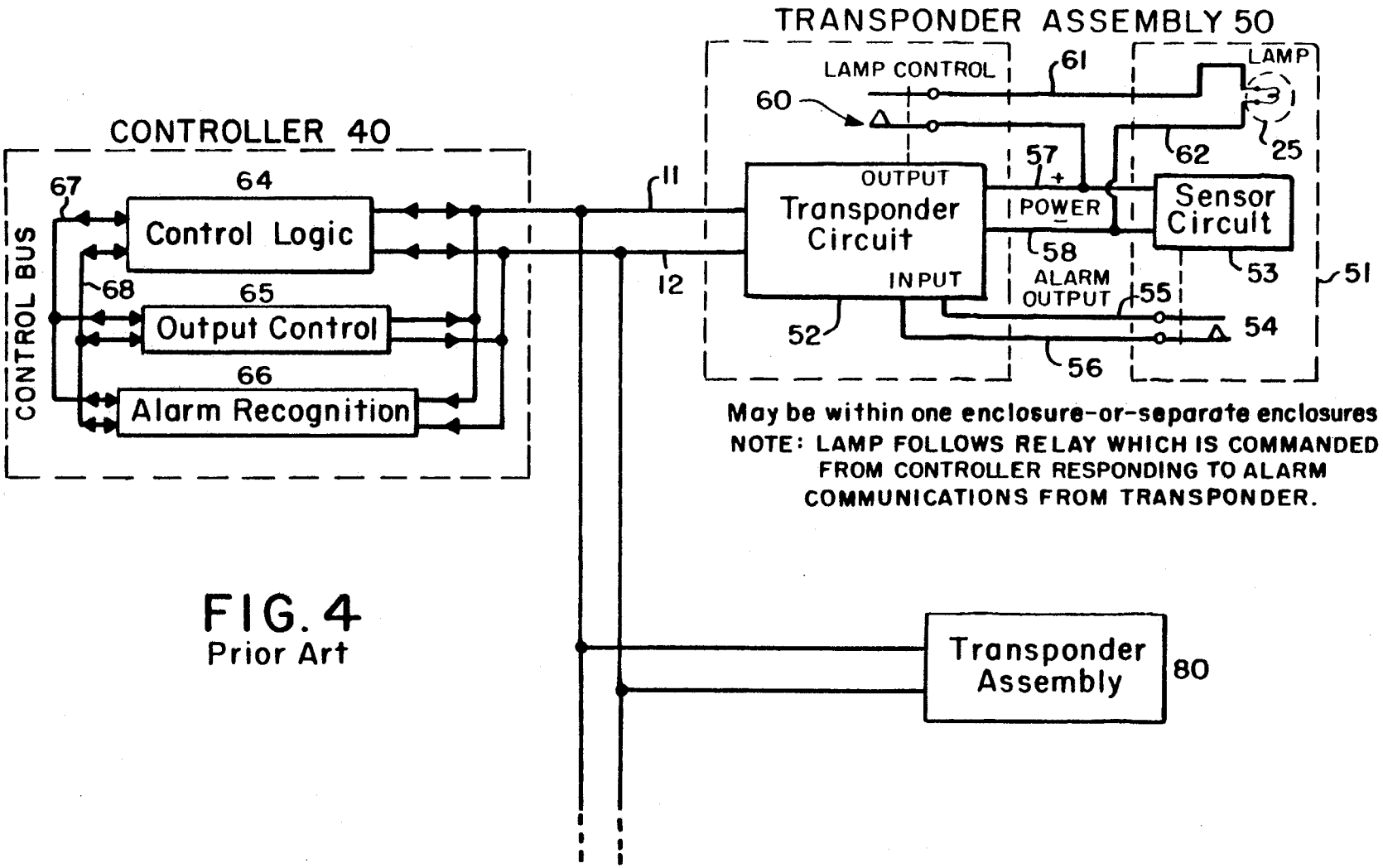
FIG. 4 Prior Art
FIG. 4 is a block diagram, partly in schematic form, depicting another known motion detector system test unit.

FIG. 1 shows a prior art arrangement in which a controller 10 is coupled over a pair of conductors 11, 12 to a plurality of motion detectors 13, 14, and 15. Together these units provide one type of security system. Additional units such as smoke detectors, intrusion detectors, rate-of-temperature-rise detectors, and similar detectors can also be added to the system to communicate over the conductor pair with controller 10. An audible indication means shown as a bell 16 is coupled over a conductor pair 17, 18, to the controller.

Motion detector 14 includes a sensor 20 which receives electrical energy over a pair of conductors 21, 22. Such power can be derived from conventional a-c power outlets, a battery source, or a battery can be connected internally in the motion detector 14. Sensor 20, upon detection of motion in the area defined by the physical placement of the sensor, provides (1) energy over conductors 23, 24 to illuminate led 25, and (2) actuates switching means 26, shown as a simple contact set. In turn closure of the contact set 26 provides an output signal over conductors 27, 28 and the main bus conductors 11, 12 to controller 10. If the output signal is implemented as an electro-mechanical relay, there is a winding (not shown) in the box with the sensor, and upon current flow through the winding, contact set 26 is closed. In general however the switching means is implemented with a simple semiconductor switch such as a transistor, with the energization signal being that used to gate on the base-emitter circuit and provide conduction between collector and emitter, thus developing the signal for passage over conductors 27, 28 and 11, 12 back to the controller. The terms "switch means" and "switching means" as used herein and in the appended claims embrace semiconductor switches, relays, and other conventional switching arrangements.

The way sensor 20 is checked during a a walk test is by the one performing the test moving in the zone adjacent motion detector 14. Upon detecting the motion, sensor 20 provides an appropriate energizing potential difference over conductors 23 and 24 to illuminate led 25, and actuates the switch means represented by contact set 26 to send the signal back to controller 10. In its turn controller 10 can ring bell 16 so that someone adjacent the bell will know motion has been detected, but will not know which specific detector has provided the signal.

FIG. 2 depicts a motion detector 30 which differs from motion detector 14 and its circuitry by the inclusion of a lamp enable switch 31. This is a simple mechanical switch which can be actuated by a person standing under the motion detector, and displacing the switch to complete the circuit for test. After switch closure, subsequent movement of a party in the protective zone will cause sensor 20 to develop a signal which is passed over contact set 31 to illuminate led 25. The switch must then be re-opened, either manually or by a dash-pot relay or similar actuator. Switch 31 is generally set in its desired position at the time the system is installed. It can be placed in the normally-open position, as shown, and remain in this position except for brief closure during a walk test.

Motion detector 32 in FIG. 3 differs from that of FIG. 2 in that the mechanical lamp enable switch is replaced by a lamp enable signal provided from controller 10 (FIG. over conductor 33 to sensor circuit 20. This signal conditions sensor circuit 20 so that, upon detection of motion in the protected area, contact set 26 is closed to send back a signal to the controller, and at the same time contact set 34 is closed to energize led 25. Such an arrangement can include an automatic restoration feature, such as a dashpot relay, for automatically removing the enable signal at a predetermined interval after receipt of the lamp enable signal over conductor 33.

FIG. 4 depicts a controller 40 coupled over a conductor pair 12 to a transponder assembly 50, which includes a motion detector circuit 51 and an internal transponder circuit 52. Motion detector 51 includes a sensor circuit 53 connected, upon sensing movement in the adjacent area, to close a contact set 54. Contact set 54 in its turn is connected to provide an alarm output signal over conductors 55, 56 to transponder circuit 52. Power is supplied to the transponder circuit from conductors 57, 58, representing any conventional power source, and this energy is also supplied to sensor circuit 53. An energizing circuit for led 25 extends from power conductor 57 over led control contact set 60, conductor 61, the filament of the led itself, and conductor 62 back to conductor 58.

Controller 40 includes a control logic circuit 64, an output control circuit 65 and an alarm recognition circuit 66. The controller can communicate in both directions with addressable transponders 70 and 80, and any other units coupled to conductors 11, 12.

In the system of FIG. 4, when a person walks in the zone protected by the position and orientation of sensor circuit 53, an output signal is provided by the sensor circuit to effect closure of contact set 54, so that this alarm output signal is passed to the input connections of transponder circuit 52. In turn the transponder circuit communicates over conductors 11, 12 with controller 40, and the alarm output signal is verified in alarm recognition circuit 66. In turn alarm recognition circuit 66 provides a signal over the control bus 67, 68 to output control circuit 65. In cooperation with the control logic circuit 64, output control circuit 65 passes a control signal over conductors 11, 12 to transponder circuit 52, causing it to close contact set 60 and complete the energizing circuit for led 25. As soon as the person moves from the zone of sensor circuit 53, contact set 54 is opened and the transponder circuit indicates over conductors 11, 12 that there is no longer an alarm output signal from the sensor circuit. In turn the output control circuit 65 removes the control signal from conductors 11, 12 and effects opening of lamp control contact set 60, de-energizing led 25.

The system of FIG. 4 suffers from the system delay occasioned by sending each alarm indication through sensor circuit 53, through the transponder circuit back to controller 40, and then back again to transponder circuit 52 to close contact set 62 and illuminate led 25. This means the system delay is present each time a person walks adjacent the protected zone, and the entire loop circuit must be traversed before it is turned on.

DETAILED DESCRIPTION OF THE PRESENT INVENTION

The security system of the present invention is particularly useful with bidirectional communication systems which employ addressable transponders. Examples of such systems can be found in U.S. Pat. No. 4,394,655 issued Jul. 19, 1983; U.S. Pat. No. 4,470,047, which issued Sep. 4, 1984, and U.S. Pat. No. 4,507,652, issued Mar. 26, 1985. All these patents are entitled "Bidirectional, Interactive Fire Detection System", and all are assigned to the assignee of the present invention. The teachings of these references are incorporated by reference in this application.

Figure 5:
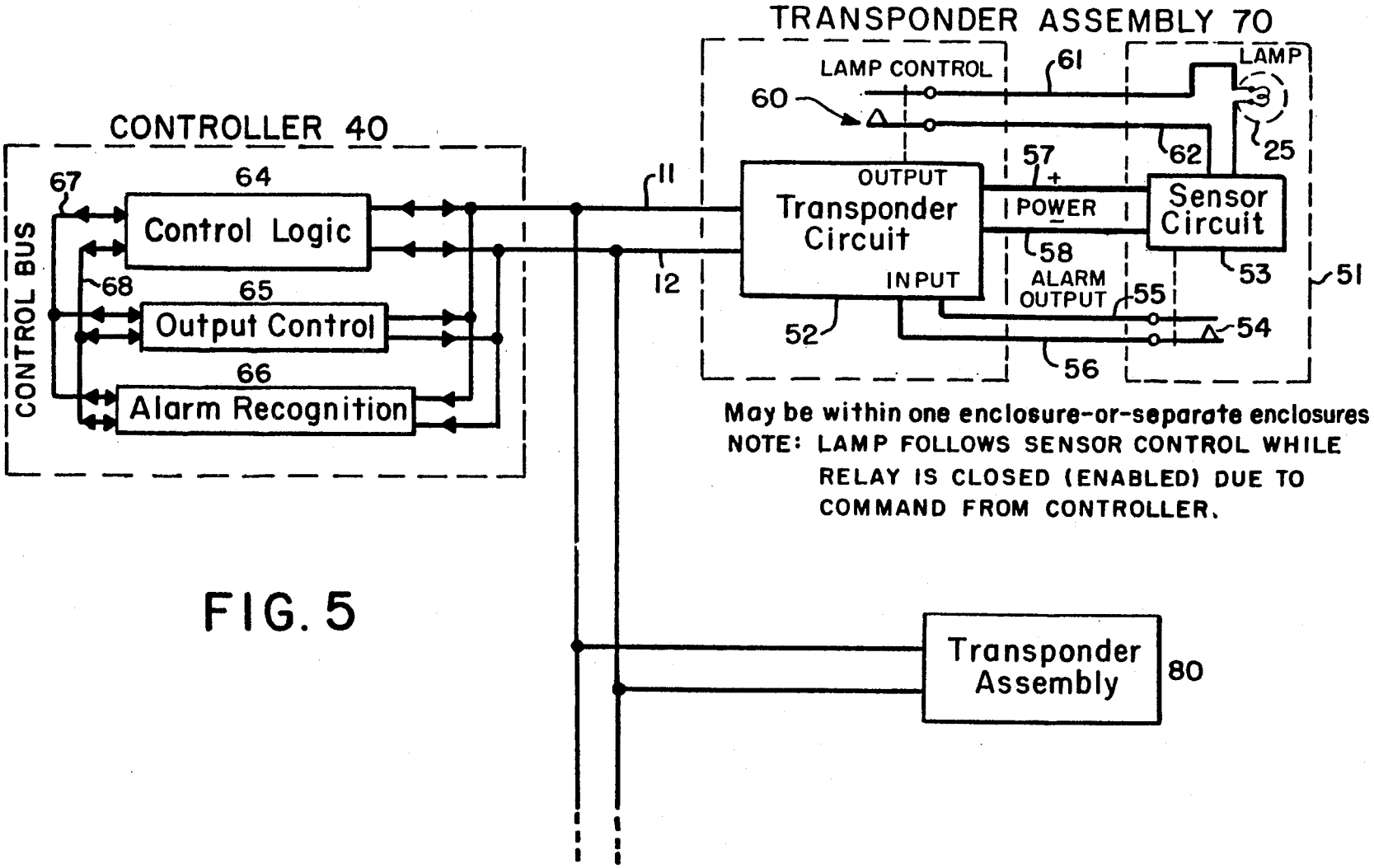
FIG. 5 is a block diagram, partly in schematic form, depicting a system including the motion detector improvement of the present invention.

In the system depicted in FIG. 5, the present invention includes a transponder assembly 70 which also has a motion detector 51 and a transponder circuit 52, but differs in the intercoupling between the lamp control switch contact set 60 and the led 25. Particularly in accordance with the present invention, receipt of an initial energize-led signal from controller 40, after recognizing an alarm condition adjacent the sensor circuit 53, is effective to close contact set 60 so that each subsequent detection of movement adjacent to the sensor will illuminate led 25. The power conductors 57, 58 are coupled to the sensor circuits so that power is always available to energize led 25 as soon as switch contact set 60 is closed. After the initial traversal of the loop, "telling" the controller that an alarm has been sensed at the transponder assembly, and then the return of the control signal to the transponder circuit to complete the circuit for illuminating led 25, there is no delay in each subsequent energization of the led. Thus in such a test controller 40 through its alarm recognition circuit 66 provides a positive identification of receipt of the initial alarm output signal from the transponder assembly 70, and then energizes the supply circuit for led 25 so that each successive output from sensor circuit 53 illuminates led 25. Thus the system depicted in FIG. 5 has the advantage of checking the interaction with the controller during the first alarm condition, but thereafter there is no system delay, because closure of contact set 60 ensures the led 25 is energized instantly upon provision of the output potential difference by sensor circuit 53.

Figure 6:
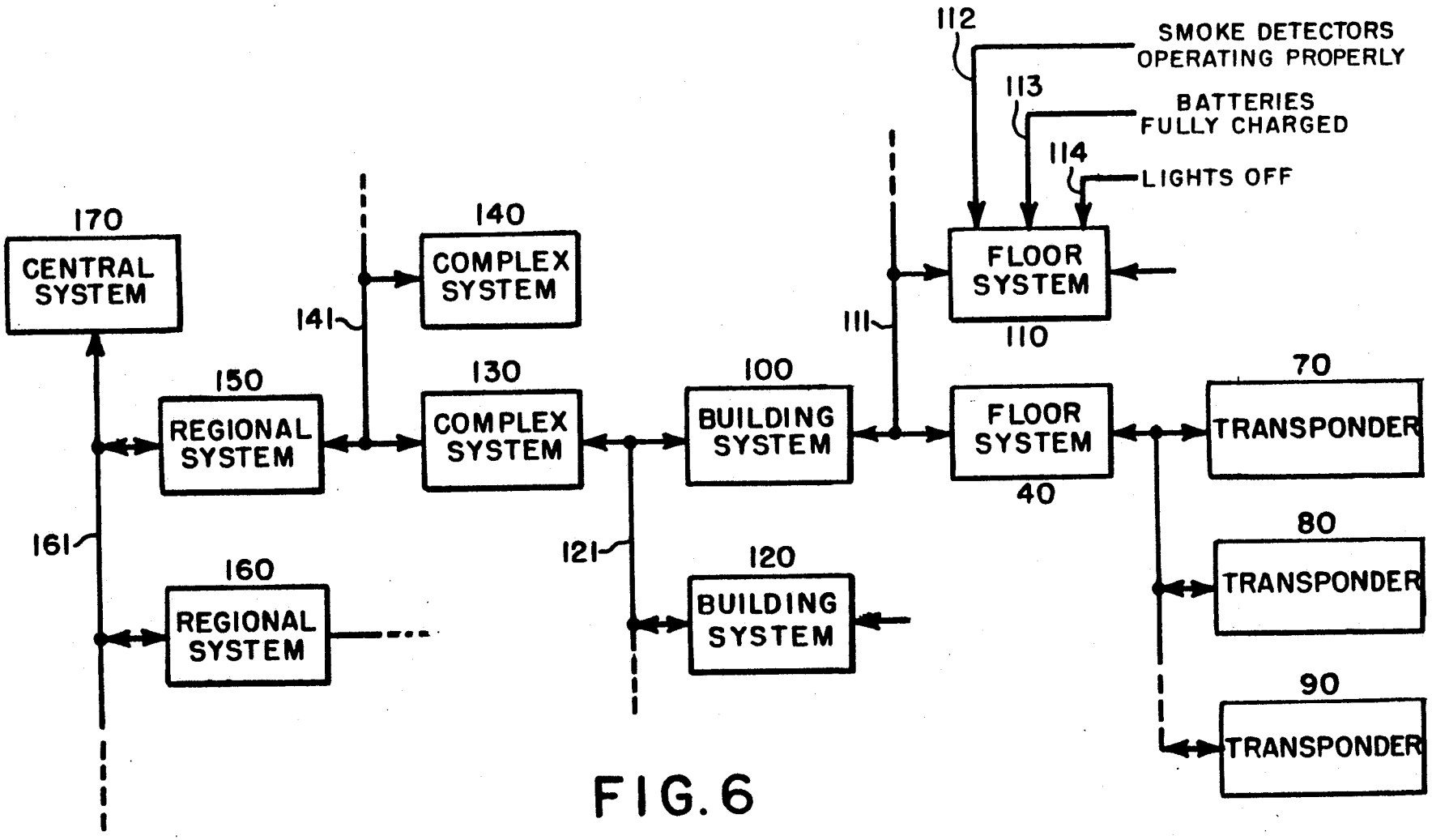
FIG. 6 is a block diagram illustrating use of the present invention in a system more complex than that shown in FIG. 5.

FIG. 6 depicts additional, important uses of the present invention, both in connection with a hierarchical system and one in which one or more condition-indicating signals may also be utilized. More specifically, controller 40 as depicted in the previous figures is shown in FIG. 6 as a floor system controller, for communicating with the transponders 70, 80, 90 and any others which may be connected for monitoring by this controller. However controller 40 may itself be in communication with another controller 100, a building system controller for regulating the various floor system controllers such as 40, 110, and any other controllers which may be connected to bus 111. In such an arrangement the building system controller is considered a first order controller, and floor system controllers 40 and 110 are second order controllers, reporting upstream to the first order controller 100 and additionally in two-way communication with the various transponders coupled to the individual room systems. For example when a motion or walk test is conducted adjacent transponder 80, the signal can be passed back through second order controller 40 to building system controller 100, which then recognizes the alarm signal or walk test indication. The output control signal is then provided from first order controller 100 back through second order controller 40 to transponder 80 to energize the led, signifying that all systems are go.

Those skilled in the art will appreciate that other systems may be used in the hierarchy of components. By way of example another building system controller 120 can be coupled over bus 121 so that building systems 100 and 120 communicate with the next higher order controller 130, set up to govern all the building system controllers in a particular complex such as an industrial park, plurality of apartment buildings or other structural arrangements. Additional complex controllers such as 140 can be used and can communicate over bus 141 to a regional system controller 150, which can regulate all the complex controllers in a geographical area. This regional system controller and any others, such as 160, in turn can be regulated by one central system controller 170. Thus the invention has significant utility in that what originates as a simple walk test adjacent one transponder can determine there is effective communication through the entire hierarchy of controllers, and only when such effective operation is known, the enable signal is utilized to turn on the led. In this way all the units in the hierarchy, no matter how layered, are checked out during the simple walk test.

In accordance with another aspect of the invention, the controller can be connected to send back the energize-led signal only if one or more condition-indicating signals are present adjacent that controller. By way of example, for room system controller 110, conductor 112 represents means for providing a condition-indicating signal to controller 110. This signal can signify that the smoke detectors are operating properly, that is, that the sensitivity level is properly set and within acceptable range. Likewise another condition-indicating signal can be supplied over conductor 113, denoting that the battery supplying room system controller 110 is fully charged and ready for operation. Another signal, on line 114, can indicate that the lights have been properly turned off at the low-usage time for this particular room. Additional signals such as heat turned down, and whatever other information may be desired, can also be provided to controller 110. In this way any individual controller can be connected and programmed to send back the led-energizing signal in response not only to the walk test indication but also the presence of all the condition-indicating signals normally presented to that individual controller. Thus a great amount of information is determined from a simple walk test by utilizing the arrangement of the present invention.

As noted above, the invention is particularly useful with bidirectional, addressable communication systems of the type referenced in the three patents incorporated by reference. Those skilled in the art will recognize that other indicator units can be substituted for the led, and similarly variations can be made in the transponder assembly and its components.

In the appended claims the term "connected" means a d-c connection between two components with virtually zero d-c resistance between those components. The term "coupled" indicates there is a functional relationship between two components, with the possible interposition of other components and/or air, between the two components described as "coupled" or "intercoupled".

While only particular embodiments of the invention have been described and claimed herein, it is apparent that various modifications and alterations of the invention may be made. It is therefore the intention in the appended claims to cover all such modifications and alterations as may fall within the true spirit and scope of the invention.

What is claimed is:

1. A security system utilizing bidirectional communication, comprising:

a controller operable to send and receive signals; and a plurality of addressable transponders connected for communication with the controller, at least one of said transponders including sensor means, means for sending an alarm signal from the one transponder to the controller when a first motion is detected in an area adjacent the sensor means, and means, in said controller, operative responsive to receipt of said alarm signal to pass a command signal to the one transponder for displaying a first alarm status indication at the one transponder to signify motion in the area adjacent the sensor, which system operates such that each subsequent motion adjacent the sensor means provides an alarm status indication directly at the one transponder, without requiring communication with the controller for the second, and any subsequent, provision of the alarm status indication.

2. A security system utilizing bidirectional communication, comprising:

a controller operable to send and receive signals; and a plurality of addressable transponders connected for communication with the controller, at least one of said transponders including sensor means for providing a first signal in response to a first motion in an area adjacent the sensor means, an alarm status indicator for providing an alarm status indication, means, coupled to said sensor means, for sending an alarm signal from the one transponder to the controller when motion is detected in the area of the sensor means, and means, in said controller, operative responsive to receipt of said alarm signal to pass a command signal to the one transponder for completing a control circuit to provide a first alarm status indication and thereby signify motion in the area of the sensor means, which control circuit remains completed so that any motion, subsequent to said first motion, adjacent the sensor means provides an alarm status indication directly from the sensor means, without requiring another communication with the controller.

3. In a security system having a controller communicating bidirectionally with a plurality of addressable transponders, with a sensor circuit and an alarm-indicating component associated with at least one of the transponders, the method of testing the system components comprising the steps of:

producing a first alarm condition at the one transponder;

passing an alarm signal from the one transponder to the controller;

recognizing the alarm signal at the controller and providing an output control signal back to the transponder; and utilizing the output control signal to enable the alarm-indicating component at the one transponder, such that said alarm-indicating component remains enabled to immediately display each alarm condition subsequent to the first alarm condition without communicating back to the controller.

4. A hierarchical security system utilizing bidirectional communication, comprising:

a first order controller operable to send and receive signals;

a second order controller operable to communicate with the first order controller, and to send and receive signals; and a plurality of addressable transponders connected for communication with the second order controller, at least one of said transponders including sensor means for providing a first signal in response to a first motion in an area adjacent the sensor means, an alarm status indicator for providing an alarm status indication, means, coupled to said sensor means, for sending an alarm signal from the one transponder through the second order controller to the first order controller when said first motion is detected in the area of the sensor means, and means, in said first order controller, operative responsive to receipt of said alarm signal to pass a command signal through the second order controller to the one transponder for completing a control circuit to actuate the alarm status indicator and thereby signify motion in the area of the sensor means, which control circuit remains completed so that each subsequent motion adjacent the sensor means provides actuation of the alarm status indicator directly from the sensor means, without requiring another communication with the controllers.

5. In a security system having first and second order controllers communicating bidirectionally with a plurality of addressable transponders, with a sensor circuit and an alarm-indicating component associated with at least one of the transponders, the method of testing the system components comprising the steps of:

producing an alarm condition at the one transponder;

p1 passing an alarm signal from the one transponder through the second order controller to the first order controller;

recognizing the alarm signal at the first order controller and providing an output control signal back through the second order controller to the one transponder; and utilizing the output control signal to enable the alarm-indicating component at the one transponder, such that said alarm-indicating component remains enables to immediately display each subsequent alarm condition without communicating back to the controllers.

6. A security system utilizing bidirectional communication, comprising:

a controller operable to send and receive signals;

means for providing at least one condition-indicating signal to said controller; and a plurality of addressable transponders connected for communication with the controller, at least one of said transponders including sensor means for providing a first signal in response to motion in a area adjacent the sensor means, and an alarm status indicator for providing an alarm status indication, means, coupled to said sensor means, for sending an alarm signal from the one transponder to the controller when a first motion is detected in the area adjacent the sensor means, and means, in said controller, operative responsive to receipt of said alarm signal to pass a command signal to the one transponder for completing a control circuit to actuate the alarm status indicator and thereby signify said first motion in the area of the sensor means only if said condition-indicating signal is present at said transponder, which control circuit remains completed so that each subsequent motion adjacent the one transponder provides actuation of the alarm status indicator directly from the sensor means, without again communicating with the controller.

7. In a security system having a controller communicating bidirectionally with a plurality of addressable transponders and also receiving at least one condition-indicating signal, with a sensor circuit and alarm-indicating component associated with at least one of the transponders, the method of testing the system components comprising the steps of:

producing an alarm condition adjacent the sensor circuit;

passing an alarm signal from the one transponder to the controller;

recognizing the alarm signal at the controller;

testing for presence of said condition-indicating signal, and providing an output control signal back to the transponder only if said condition-indicating signal is present; and utilizing the output control signal to enable the alarm-indicating component at the one transponder, such that said alarm-indicating component remains enables to immediately display each subsequent alarm condition without again communicating back to the controller.

* * * * *